US010724209B2

(12) United States Patent
Zell

(10) Patent No.: US 10,724,209 B2
(45) Date of Patent: Jul. 28, 2020

(54) ADJUSTABLE WORK IMPLEMENT

(71) Applicant: Deere & Company, Moline, IL (US)

(72) Inventor: Adam Zell, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 182 days.

(21) Appl. No.: 15/952,695

(22) Filed: Apr. 13, 2018

(65) Prior Publication Data

US 2019/0316324 A1 Oct. 17, 2019

(51) Int. Cl.

| | |
|---|---|
| ***E02F 9/22*** | (2006.01) |
| ***E02F 3/84*** | (2006.01) |
| ***E02F 3/76*** | (2006.01) |
| ***F15B 13/04*** | (2006.01) |
| ***F15B 13/02*** | (2006.01) |
| ***F15B 19/00*** | (2006.01) |
| ***E02F 9/20*** | (2006.01) |

(52) U.S. Cl.

CPC ..... *E02F 9/2225* (2013.01); *E02F 3/7636* (2013.01); *E02F 3/844* (2013.01); *E02F 9/2004* (2013.01); *E02F 9/2267* (2013.01); *F15B 13/024* (2013.01); *F15B 13/04* (2013.01); *F15B 19/005* (2013.01); *F15B 2211/8606* (2013.01)

(58) Field of Classification Search

CPC ..... E02F 9/2225; E02F 9/2267; E02F 9/2271; F15B 2211/8606

USPC ..... 172/5, 663

See application file for complete search history.

(56) References Cited

U.S. PATENT DOCUMENTS

| | | | | |
|---|---|---|---|---|
| 4,793,183 | A * | 12/1988 | Helmus | E02F 5/145 346/8 |
| 5,775,075 | A * | 7/1998 | Dannar | A01D 34/866 56/15.2 |
| 6,134,814 | A * | 10/2000 | Christy | E01H 5/06 37/236 |
| 6,988,363 | B2 | 1/2006 | Bitter | |
| 8,495,870 | B2 * | 7/2013 | Sumiyoshi | E02F 9/2232 60/444 |
| 8,695,333 | B2 | 4/2014 | Vigholm et al. | |
| 8,793,907 | B2 * | 8/2014 | Walimaa | E01H 5/065 37/234 |
| 9,255,380 | B2 | 2/2016 | Ault et al. | |
| 9,315,958 | B2 * | 4/2016 | Walimaa | E01H 5/065 |

* cited by examiner

*Primary Examiner* — Gary S Hartmann
(74) *Attorney, Agent, or Firm* — Michael Best & Friedrich LLP

(57) ABSTRACT

A control system controls movement of a work implement of a work vehicle and includes a pump, a first actuator in fluid communication with the pump, a first control valve fluidly positioned between the pump and the first actuator, a first proportional relief valve fluidly positioned between the pump and the first actuator, a second actuator in fluid communication with the pump, a second control valve fluidly positioned between the pump and the second actuator, and a second proportional relief valve fluidly positioned between the pump and the second actuator. The first proportional relief valve permits flow of fluid from the first actuator upon an impact at a first set force. The first set force is adjusted by a user. The second proportional relief valve permits egress of fluid from the second actuator upon an impact at a second set force. The second set force is adjusted by a user.

16 Claims, 4 Drawing Sheets

ADJUSTABLE WORK IMPLEMENT

BACKGROUND

The present disclosure relates to a work vehicle which includes a work implement.

SUMMARY

In some embodiments, the disclosure provides a work vehicle comprising a frame, a prime mover connected to the frame, an operator cab connected to the frame, a work implement moveable with respect to the frame, and a control circuit that can control movement of the work implement. The control circuit includes a pump, an actuator in fluid communication with the pump, a control valve fluidly positioned between the pump and the actuator, and a proportional relief valve fluidly positioned between the pump and the actuator. The proportional relief valve can permit flow of fluid from the actuator in response to an impact at a predetermined force, and the predetermined force is adjustable by a user.

In some embodiments, the disclosure provides a control system that controls movement of a work implement of a work vehicle. The control system includes a pump, a first actuator in fluid communication with the pump, a first control valve fluidly positioned between the pump and the first actuator, a first proportional relief valve fluidly positioned between the pump and the first actuator, a second actuator in fluid communication with the pump, a second control valve fluidly positioned between the pump and the second actuator, and a second proportional relief valve fluidly positioned between the pump and the second actuator. The first proportional relief valve permits flow of fluid from the first actuator upon an impact at a first set force. The first set force is adjusted by a user. The second proportional relief valve permits egress of fluid from the second actuator upon an impact at a second set force. The second set force is adjusted by a user.

In some embodiments the disclosure provides a method of moving a work implement of a work vehicle in response to an impact force. The method includes setting a pressure at which a proportional relief valve is configured to open via an operator positioned in the work vehicle, and monitoring an actuator to detect movement thereof from a first position. Upon movement of the actuator from the first position, the method includes determining if an operator commanded the actuator to move. If an operator commanded the actuator to move, the method includes detecting a second position of the actuator. If an operator did not command the actuator to move, the method includes moving the actuator back to the first actuator position.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
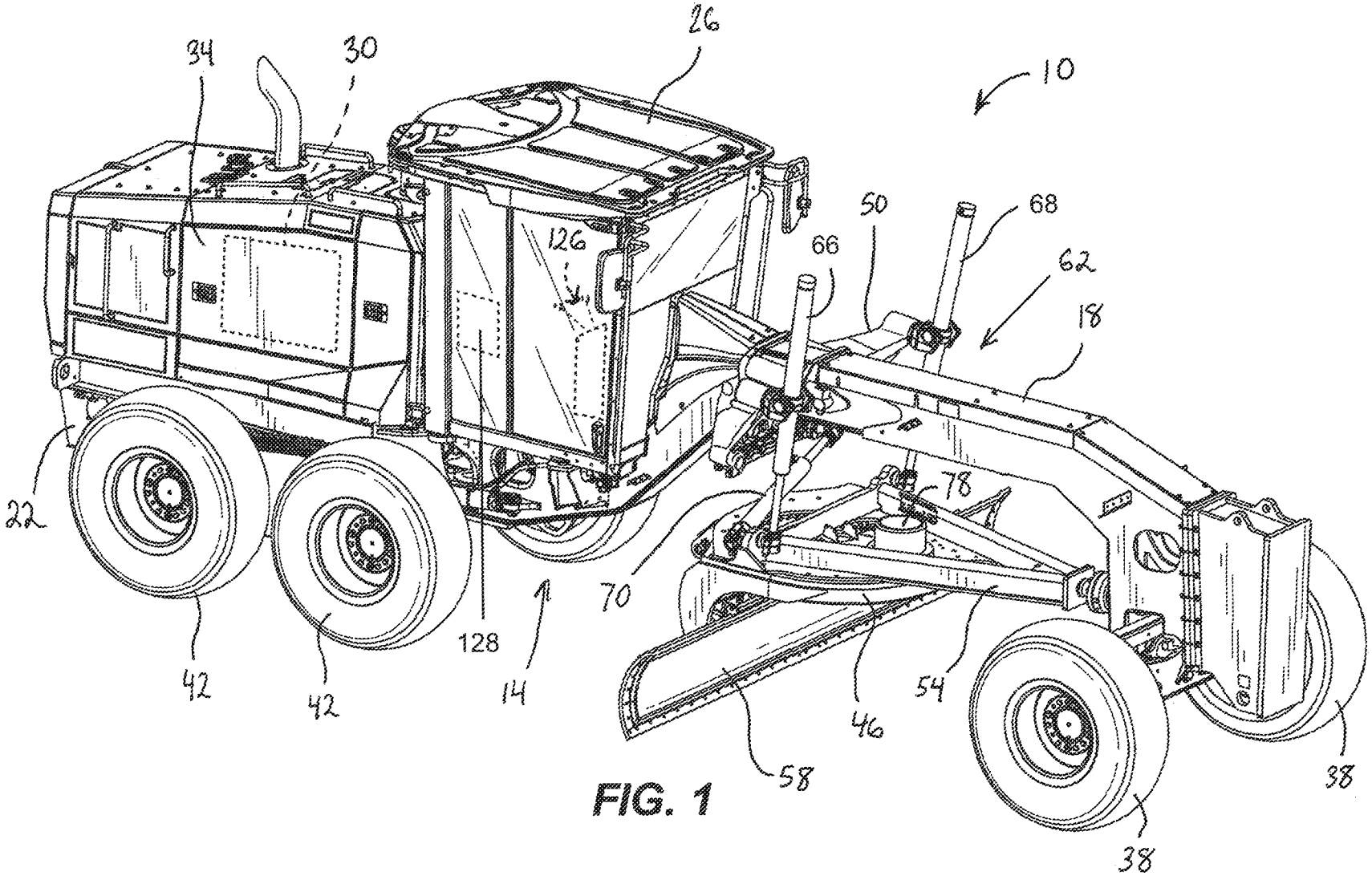
FIG. 1 is a perspective view of a work vehicle in which the disclosed hydraulic articulation system may be implemented.

FIG. 1 illustrates a work vehicle, which is a motor grader (or simply "grader") 10 in the illustrated embodiment. The grader 10 includes a chassis 14 with a front frame 18 and a rear frame 22. The front frame 18 supports an operator cab 26 that may include an operator seat, controls for operating the grader 10, and the like. A prime mover 30 (e.g., a diesel engine) is supported on the rear frame 22 and is enclosed within a compartment 34. The chassis 14 is supported by front wheels 38 at the front of the grader 10 and by tandem rear wheels 42 at the rear of the grader 10.

The grader 10 includes a circle 46 disposed in front of the operator cab 26 and suspended below the front frame 18 by a lifter bracket 50 and a drawbar 54. A work implement, which is a blade 58 or moldboard in the illustrated embodiment, extends laterally across the circle 46. The grader 10 includes a blade positioning assembly 62 that allows the position and orientation of the blade 58 to be adjusted. In the illustrated embodiment, a left lift actuator 66 and a right lift actuator 68 extend between the lifter bracket 50 and the circle 46 to tilt, raise, and lower the circle 46 and the blade 58. A shift actuator 70 is provided to shift the blade 58 laterally relative to the front frame 18, and a pitch actuator 74 (FIG. 2) is provided to vary a pitch angle of the blade 58. The blade positioning assembly 62 also includes a rotary actuator 78 to rotate the blade 58 about a vertical axis. In the illustrated embodiment, the various actuators 66, 68, 70, 74, 78 of the blade positioning assembly 62 are hydraulic actuators (e.g., single or double acting cylinders, hydraulic motors, etc.); however, the blade positioning assembly 62 may alternatively include one or more electric motors, pneumatic actuators, or the like in place of any of the hydraulic actuators 66, 68, 70, 74, 78.

Figure 2:
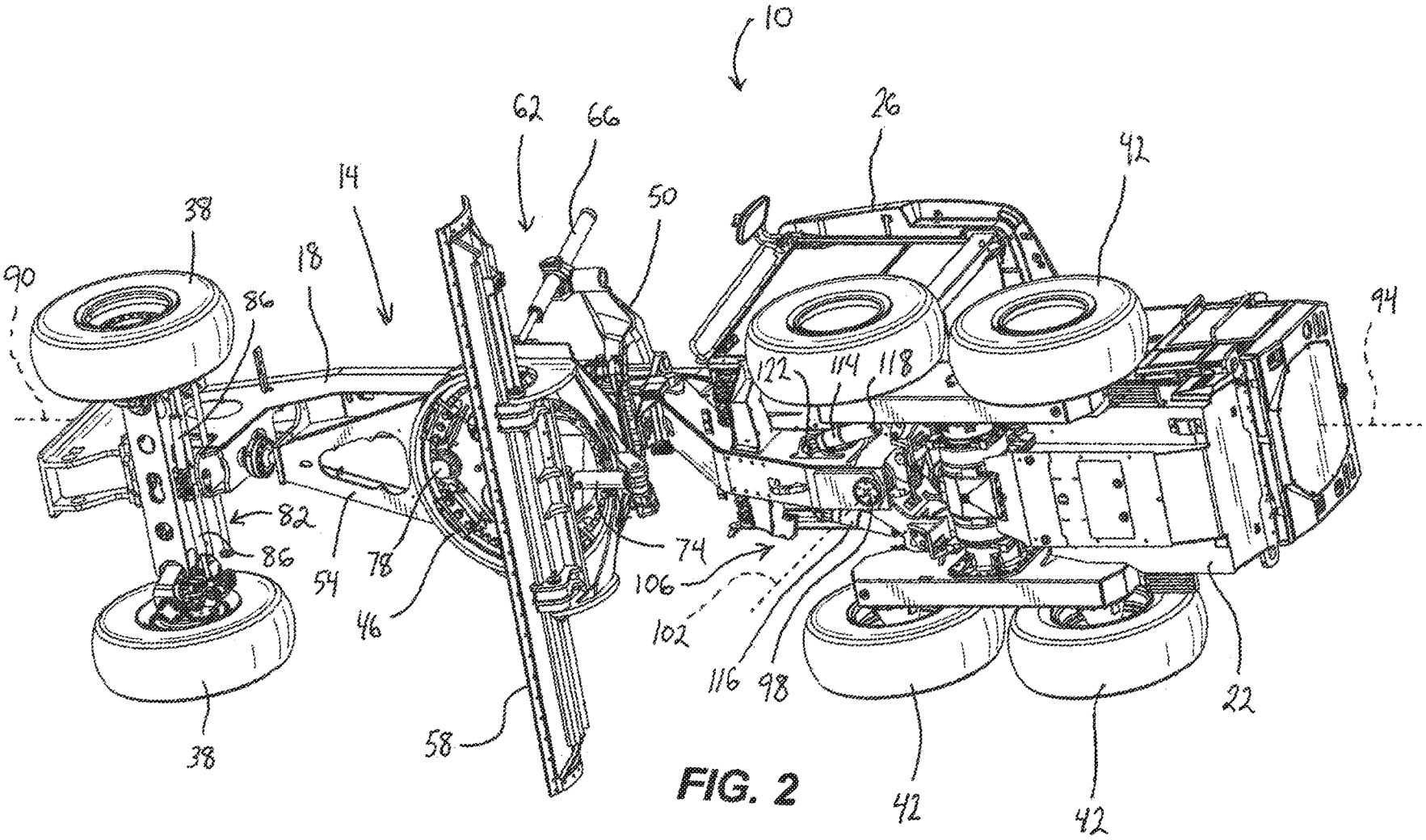
FIG. 2 is another perspective view of the work vehicle of FIG. 1.

The prime mover 30 is coupled to the rear wheels 42 via a suitable transmission (not shown) to drive the rear wheels 42 (FIG. 1). Alternatively or additionally, the prime mover 30 may be coupled to the front wheels 38 to drive the front wheels 38. The front frame 18 supports a steering assembly 82 for steering the front wheels 38 (FIG. 2). The steering assembly 82 includes steering actuators 86, which are hydraulic actuators in the illustrated embodiment. In other embodiments, other types of actuators can be used. In addition, in some embodiments, additional steering actuators may be provided such that both the front wheels 38 and the rear wheels 42 may be steerable.

The front frame 18 of the grader 10 defines a first or front longitudinal axis 90, and the rear frame 22 of the grader 10 defines a second or rear longitudinal axis 94. An articulation joint 98 pivotally couples the front frame 18 and the rear frame 22 and defines a vertical pivot or articulation axis 102 (FIG. 2). The front frame 18 is pivotable relative to the rear frame 22 about the articulation axis 102 to vary an orientation of the front longitudinal axis 90 relative to the rear longitudinal axis 94. The illustrated articulation joint 98 is part of an active articulation assembly 106 that includes first and second articulation actuators 114, 116 extending between the front frame 18 and the rear frame 22 on opposite lateral sides of the articulation axis 102. Each of the illustrated articulation actuators 114, 116 is a double-acting hydraulic cylinder having a head 118 pivotally coupled to the rear frame 22 and a rod 122 pivotally coupled to the front frame 18. In other embodiments, the number and/or arrangement of articulation actuators 114, 116 may vary.

As shown in FIG. 1, a user-manipulable control 126 is positioned in the in the operator cab 26 to permit the user to operate the grader 10. In some embodiments, a user could operate the grader 10 from a location outside of the cab (i.e., by remote control). The illustrated grader 10 includes a control system 128 that is configured to control operation of various components of the grader 10 in response to input from the user-manipulable control 126 and/or one or more controls remote from the grader 10.

Figure 3:
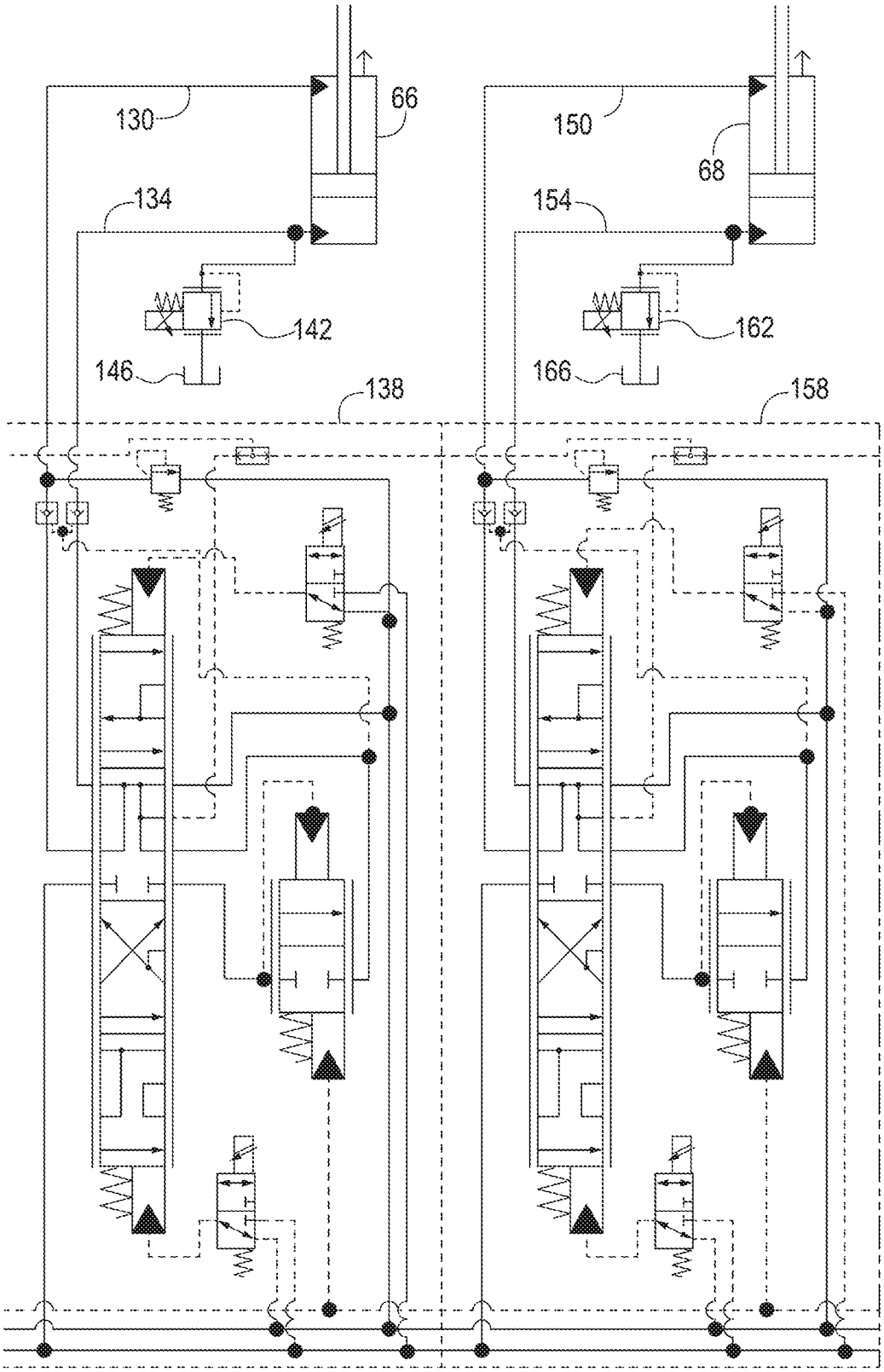
FIG. 3 is a schematic diagram of a hydraulic articulation system according to one embodiment of the disclosure.

FIG. 3 illustrates a schematic view of a portion of a hydraulic fluid flow circuit for the left lift actuator 66 and the right lift actuator 68. The left lift actuator 66 includes a rod side that is fluidly coupled to a first conduit 130 and a piston side that is fluidly coupled to a second conduit 134. The first conduit 130 is fluidly coupled to a left control valve 138 which selectively directs flow into and out of the rod side of the left lift actuator 66. A pump (not shown) provides a flow of pressurized fluid into the left control valve 138. The second conduit 134 is fluidly coupled to both the left control valve 138 and a left proportional relief valve 142. When the pressure in the left lift actuator 66 is above a set threshold pressure, the left proportional relief valve 142 opens to permit fluid to flow from the piston side of the left lift actuator 66 into a reservoir 146. In the illustrated embodiment, the left proportional relief valve 142 is separate from the left control valve 138. In some embodiments, the left proportional relief valve 142 is incorporated into the left control valve 138.

The right lift actuator 68 includes a rod side that is fluidly coupled to a first conduit 150 and a piston side that is fluidly coupled to a second conduit 154. The first conduit 150 is fluidly coupled to a right control valve 158 which selectively directs flow into and out of the piston side of the right lift actuator 68. A pump (not shown) provides a flow of pressurized fluid into the right control valve 158. The second conduit 154 is fluidly coupled to both the right control valve 158 and a right proportional relief valve 162. When the pressure in the right lift actuator 68 is above a set threshold pressure, the right proportional relief valve 162 opens to permit fluid to flow from the piston side of the right lift actuator 68 into a reservoir 166. In the illustrated embodiment, the right proportional relief valve 162 is separate from the right control valve 158. In some embodiments, the right proportional relief valve 162 is incorporated into the right control valve 158.

Figure 4:
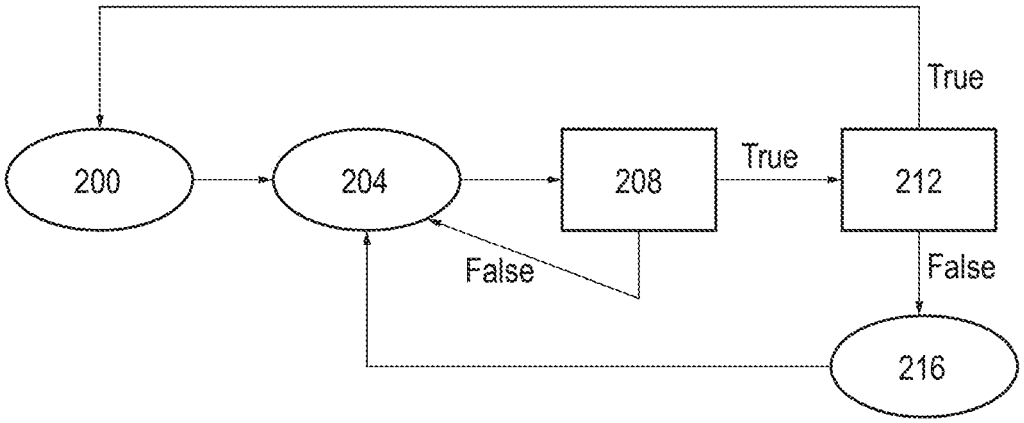
FIG. 4 is a flow diagram showing one possible mode of operation of the hydraulic articulation system.

FIG. 4 illustrates one possible mode of operation of the grader 10. The illustrated mode of operation includes capturing a position of the left and right lift actuators 66 and 68 with the control system 128 at step 200. Then, the control system 128 monitors the position of the left and right lift actuators 66 and 68 at step 204. At step 208, the control system 128 determines if the position of the left and right lift actuators 66 and 68 changes. In some embodiments, the movement is detected by one or more position sensors positioned in the left and right lift actuators 66 and 68. If the position of one or both of the left and right lift actuators 66 and 68 has changed, operation moves to step 212. If the position of both of the left and right lift actuators 66 and 68 has not changed, operation returns to step 204.

At step 212, the control system 128 determines if the movement of the one or both of the left and right lift actuators 66 and 68 was commanded by the operator. If the control system 128 determines that the movement of one or both of the left and right lift actuators 66 and 68 was commanded by the operator at step 212, operation returns to step 200. If the control system 128 determines that the movement of one or both of the left and right lift actuators 66 and 68 was not commanded by the operator at step 212, operation moves to step 216.

At step 216, the control system 128 sends a command to the one or both of the left and right lift actuators 66 and 68 to return to the captured cylinder position of step 200. Operation then returns to step 204 at which the control system 128 monitors the position of the left and right lift actuators 66 and 68. In some embodiments, step 216 can include notifying the operator to move the one or both of the left and right lift actuators 66 and 68 to the captured cylinder position. In some embodiments, step 216 includes requesting authorization from the operator to return the one or both of the left and right lift actuators 66 and 68 to the captured cylinder position. In some embodiments, step 216 includes automatically returning the one or both of the left and right lift actuators 66 and 68 to the captured cylinder position.

During operation, if the blade 58 impacts a hard object, such as a frozen object, rocks, clay, etc., a pressure in the piston side of one or both of the lift actuators 66 and 68 can increase rapidly. In response to the rapid pressure increase, one or both of the proportional relief valves 142 and 162 can open to permit fluid to exit the piston side of the respective lift actuator 66 and 68 to thereby lower the pressure on the piston side of the respective lift actuator 66 and 68. The respective one or both of the lift actuators 66 and 68 are then permitted to raise the blade 58 above the hard object to inhibit the hard object from damaging the blade 58 or any other portion of the grader 10.

In some embodiments, the lift actuators 66 and 68 are coupled such that if one of the proportional relief valves 142 or 162 exceeds a pre-determined pressure, both of the proportional relief valves 142 and 162 open to raise the blade 58. In other embodiments, the lift actuators 66 and 68 operate independently such that when one of the proportional relief valves 142 or 162 exceeds a pre-determined pressure, only the respective proportional relief valve 142, 162 opens while the other proportional relief valve 142, 162 remains closed.

The operator can set and change the pre-determined pressure at which the proportional relief valves 142, 162 open. In some embodiments, the operator can set and change the pre-determined pressure with the user-manipulable control 126 in the operator cab 26. In some embodiments, the operator can set and change the pre-determined pressure with one or more controls that are remote from the grader 10.

Thus, the disclosure provides, among other things, a work vehicle having an adjustable pressure at which one or more relief valves open to raise a work implement and in which the operator can adjust the pressure from the cab and/or from a location remote from the cab.

Various features and advantages of the disclosure are set forth in the following claims.

What is claimed is:

1. A work vehicle comprising:

a frame;

a prime mover coupled to the frame;

an operator cab coupled to the frame;

a work implement moveable with respect to the frame; and a control circuit operable to control movement of the work implement, the control circuit including a pump, an actuator in fluid communication with the pump, a control valve fluidly positioned between the pump and the actuator, and a proportional relief valve fluidly positioned between the pump and the actuator, the proportional relief valve configured to permit flow of fluid from the actuator in response to an impact at a predetermined force, wherein the predetermined force is adjustable by a user.

2. The work vehicle of claim 1, wherein the proportional relief valve is fluidly positioned between the control valve and the actuator.

3. The work vehicle of claim 1, wherein the actuator is a first actuator, the control valve is a first control valve, the proportional relief valve is a first proportional relief valve and the predetermined force is a first predetermined force, and further comprising a second actuator fluidly in fluid communication with the pump, a second control valve fluidly positioned between the pump and the second actuator, and a second proportional relief valve fluidly positioned between the pump and the second actuator, the second proportional relief valve configured to permit flow of fluid from the second actuator upon an impact at a second set force, wherein the second set force is adjustable by a user.

4. The work vehicle of claim 3, wherein the predetermined force at which the first proportional relief valve permits flow of fluid from the first actuator is adjustable independently of the second predetermined force at which the second proportional relief valve permits flow of fluid from the second actuator.

5. The work vehicle of claim 4, wherein the operator cab includes a user interface configured to permit a user to adjust the first predetermined force and the second predetermined force.

6. The work vehicle of claim 5, wherein the first predetermined force and the second predetermined force are adjustable by a user.

7. The work vehicle of claim 6, wherein the first predetermined force and the second predetermined force are adjustable by a user when the user is positioned in the operator cab.

8. The work vehicle of claim 3, wherein the second proportional relief valve is fluidly positioned between the second control valve and the second actuator.

9. The work vehicle of claim 1, wherein the proportional relief valve is fluidly connected to a first side of the actuator and is fluidly disconnected from a second side of the actuator.

10. The work vehicle of claim 1, wherein the proportional relief valve is fluidly connected to a reservoir.

11. A work vehicle of claim 1, wherein the control circuit includes a controller and a position sensor configured to sense a position of the actuator and communicate the sensed position to the controller, wherein upon movement of the actuator from the first position, the controller configured to determine if an operator commanded the actuator to move;

if an operator commanded the actuator to move, the position sensor configured to sense a second position of the actuator and communicate the second position to the controller; and if an operator did not command the actuator to move, the controller configured to move the actuator back to the first actuator position.

12. The work vehicle of claim 3, wherein a first pressure at which the proportional relief valve is configured to open is adjustable by an operator, and a second pressure at which the second proportional relief valve is configured to open is adjustable by an operator.

13. The work vehicle of claim 3, the actuator is a first actuator, and the position sensor is a first position sensor, further comprising a second actuator and a second position sensor, the second position sensor configured to detect movement of the second actuator from a second actuator first position and communicate the sensed second actuator first position to the controller.

14. The work vehicle of claim 13, wherein upon movement of the second actuator from the second actuator first position, the controller configured to determine if an operator commanded the second actuator to move;

if an operator commanded the second actuator to move, the second position sensor configured to sense a second actuator second position and communicate the second actuator second position to the controller; and if an operator did not command the second actuator to move, the controller configured to move the second actuator back to the second actuator first position.

15. The work vehicle of claim 12, wherein the first pressure at which the first proportional relief valve is configured to open is adjustable via an operator positioned in the work vehicle.

16. The work vehicle of claim 15, wherein the second pressure at which the second proportional relief valve is configured to open is adjustable via an operator positioned in the work vehicle.

* * * * *